US009516929B1

(12) United States Patent
Huang

(10) Patent No.: US 9,516,929 B1
(45) Date of Patent: Dec. 13, 2016

(54) FASTENING STRUCTURE OF JEWELLERY

(71) Applicant: H.S.H. JEWELRY INDUSTRY CO., LTD., New Taipei (TW)

(72) Inventor: Tsung-Chi Huang, New Taipei (TW)

(73) Assignee: H.S.H. JEWELRY INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/986,345

(22) Filed: Dec. 31, 2015

(51) Int. Cl.
*A44C 5/20* (2006.01)

(52) U.S. Cl.
CPC ..... *A44C 5/2047* (2013.01); *A44C 5/2066* (2013.01)

(58) Field of Classification Search
CPC ..... A44C 5/2047; A44C 5/2066; Y10T 24/45534; Y10T 24/45529; Y10T 24/45524
USPC ..... 63/3.1
See application file for complete search history.

(56) References Cited

U.S. PATENT DOCUMENTS 4,520,537 A * 6/1985 Valikov ..... A44C 5/2047 24/116 A
4,532,682 A * 8/1985 Murao ..... A44C 5/2047 24/574.1
5,231,740 A * 8/1993 Mohebkhosravi ... A44C 5/2047 24/574.1
5,272,795 A * 12/1993 Rothstein ..... A44C 5/2047 24/615
5,309,616 A * 5/1994 Sobin ..... A44C 5/2047 24/616
6,035,499 A * 3/2000 Ninomiya ..... A44C 5/2047 24/116 A

FOREIGN PATENT DOCUMENTS

FR 1523485 A * 5/1968 ..... A44C 5/2047

* cited by examiner

*Primary Examiner* — Abigail Morrell
(74) *Attorney, Agent, or Firm* — Rabin & Berdo, P.C.

(57) ABSTRACT

A fastening structure of jewelry has a chain, and a locking seat and a locking assembly respectively mounted on two ends of the chain. The locking seat has an insertion recess with two stop protrusions. The locking assembly has a V-shaped resilient locking element and a resilient supporting element. The resilient locking element has a connecting end and a locking end with a pressing protrusion. The resilient supporting element is mounted between the connecting end and the pressing protrusion. The fastening structure has a simplified structure and compact size. Moreover, when the resilient locking element is inserted into the insertion recess of the locking seat, an end edge on the locking end of the resilient locking element securely abuts against the stop protrusions of the locking seat. Accordingly, the jewelry with the fastening structure does not drop off and does not get lost.

6 Claims, 4 Drawing Sheets

FASTENING STRUCTURE OF JEWELLERY

BACKGROUND OF THE INVENTION

1. Field of the Invention

The present invention relates to jewellery, especially to a fastening structure of jewellery.

2. Description of the Prior Art(s)

People decorate themselves with cosmetics, clothes, and jewellery. The jewellery, such as a necklace, a bracelet, an anklet, and the like, has a chain and two fasteners respectively mounted on two ends of the chain. As the chain is worn around a neck, a wrist, or an ankle and the fasteners are fastened with each other, the jewellery does not drop therefrom.

With reference to FIG. 4, a conventional fastening structure of jewellery comprises a chain 40, a connecting seat 50, and a connecting assembly 60. The chain 40 has two ends.

The connecting seat 50 is attached to one of the ends of the chain 40 and has an end surface, two opposite outer side surfaces, an insertion recess 51, an end edge, a guiding slot 52, and two locking protrusions 53. The insertion recess 51 is formed in the end surface of the connecting seat 50. The end edge of the connecting seat 50 is defined on the end surface of the connecting seat 50 and around the insertion recess 51. The guiding slot 52 is formed through the connecting seat 50 and extends through the end edge of the connecting seat 50. The locking protrusions 53 are respectively formed on the outer side surfaces of the connecting seat 50.

The connecting assembly 60 is mounted on the other end of the chain 40 and has a resilient connector 61 and two locking rings 62. The resilient connector 61 is V-shaped and has a connecting end 611, an abutting end 612, an end edge, and a pressing protrusion 613. The connecting end 611 is attached to the chain 40. The abutting end 612 is opposite to and corresponds to the connecting end 611. The end edge of the resilient connector 61 is formed on the abutting end 612. The pressing protrusion 613 is formed on the end edge of the resilient connector 61. When the pressing protrusion 613 is pressed, the abutting end 612 moves toward the connecting end 611. When the pressing protrusion 613 is released, the abutting end 612 resiliently rebounds. The locking rings 62 are pivotally mounted respectively on two opposite sides of the chain 40.

During insertion of the resilient connector 61 into the insertion recess 51 of the connecting seat 50, the pressing protrusion 613 slides in and along the guiding slot 52 of the connecting seat 50, and the abutting end 612 of the resilient connector 61 is pressed by the connecting seat 50 and resiliently abuts an inner sidewall of the connecting seat 50. Then the locking rings 62 are turned to respectively hook on the locking protrusions 53 of the connecting seat 50 to prevent the resilient connector 61 from departing from the connecting seat 50.

However, when the jewellery with the conventional fastening structure is worn on the neck, the wrist, or the ankle, the locking rings 62 are easily hooked by other articles, such as clothes, hair, and so on. Accordingly, the locking rings 62 disengage from the locking protrusions 53 easily. Moreover, the resilient connector 61 lacks elasticity after a long-term use and cannot abut against the connecting seat 50 firmly. Thus, the resilient connector 61 slides out of the insertion recess 51 of the connecting seat 50 easily even by a slight pull, causing the ends of the chain 40 to disengage from each other and the jewellery drops off and gets lost. Furthermore, although the locking protrusions 53 of the connecting seat 50 and the locking rings 62 on the connector 61 allow the ends of the chain 40 to securely connect to each other, the locking protrusions 53 and the locking rings 52 also cause the conventional fastening structure to have a complicated structure and bulky size.

To overcome the shortcomings, the present invention provides a fastening structure of jewellery to mitigate or obviate the aforementioned problems.

SUMMARY OF THE INVENTION

The main objective of the present invention is to provide a fastening structure of jewellery. The fastening structure has a chain, and a locking seat and a locking assembly respectively mounted on two ends of the chain. The locking seat has an insertion recess with two stop protrusions. The locking assembly has a V-shaped resilient locking element and a resilient supporting element. The resilient locking element has a connecting end and a locking end with a pressing protrusion. The resilient supporting element is mounted between the connecting end and the pressing protrusion.

When the resilient locking element is inserted into the insertion recess of the locking seat, an end edge on the locking end of the resilient locking element abuts against the stop protrusions of the locking seat. The fastening structure has a simplified structure and compact size. Moreover, the locking end of the locking element does not disengage from the stop protrusions of the locking seat easily, so the locking element does not depart from the locking seat easily. Accordingly, the jewellery with the fastening structure does not drop off and does not get lost.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
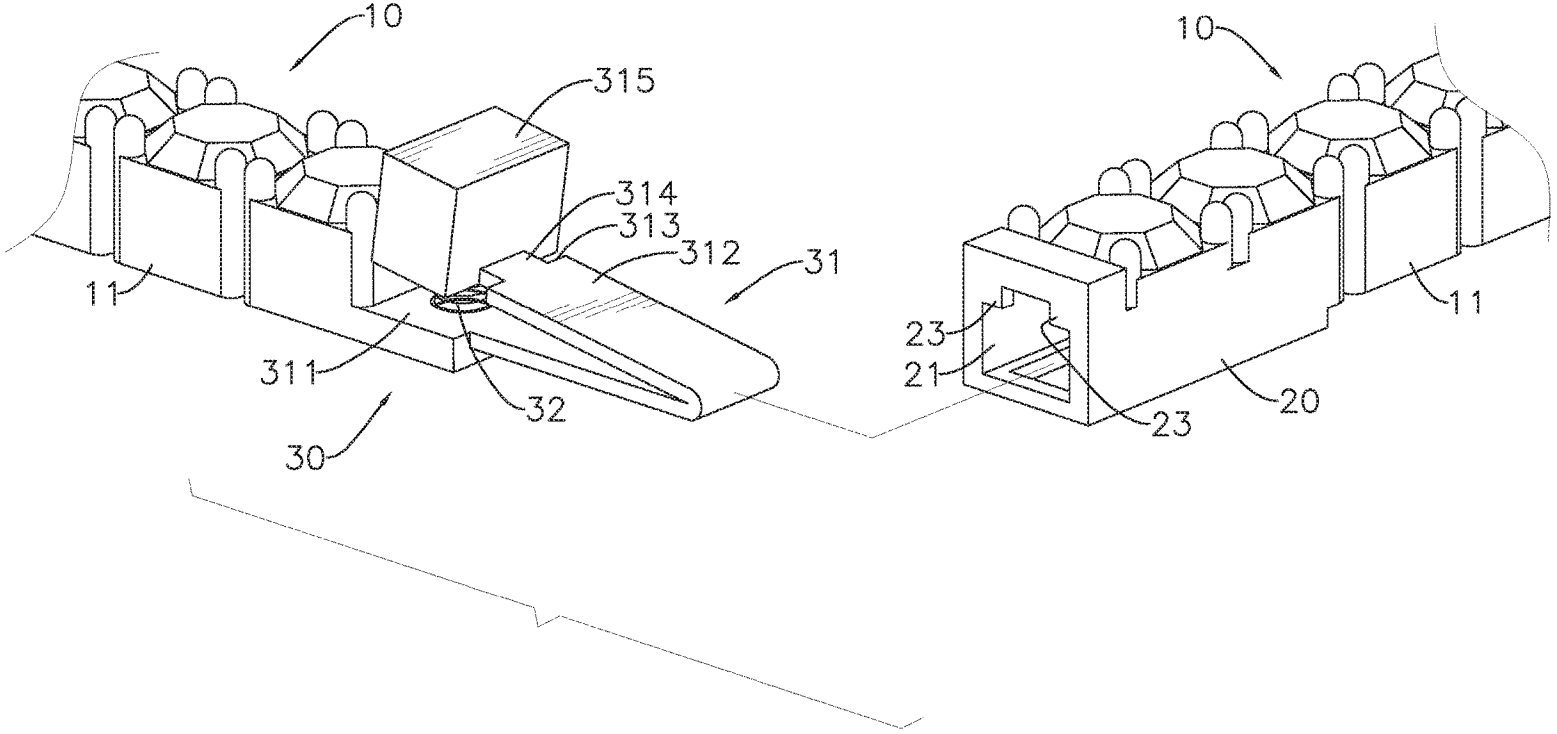
FIG. 1 is an enlarged perspective view of a fastening structure of jewellery in accordance with the present invention, shown unfastened.
Figure 3:
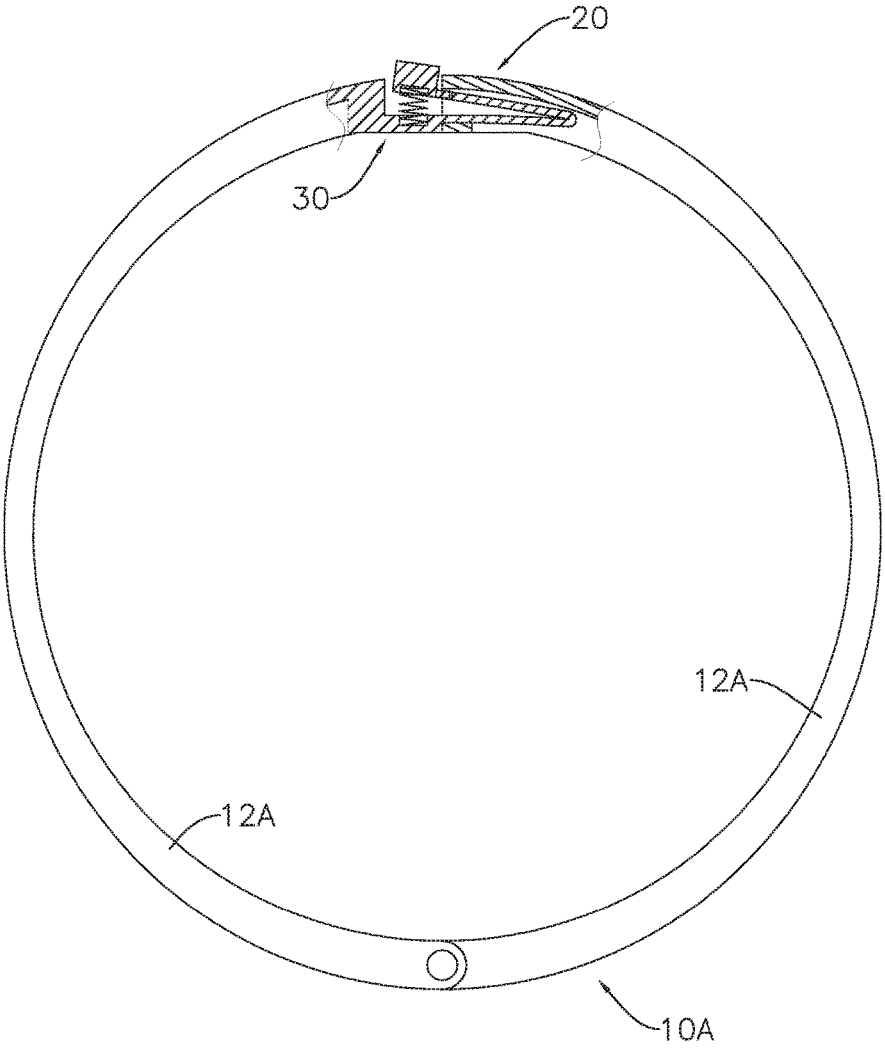
FIG. 3 is a side view in partial section of another preferred embodiment of a fastening structure of jewellery in accordance with the present invention.
Figure 4:
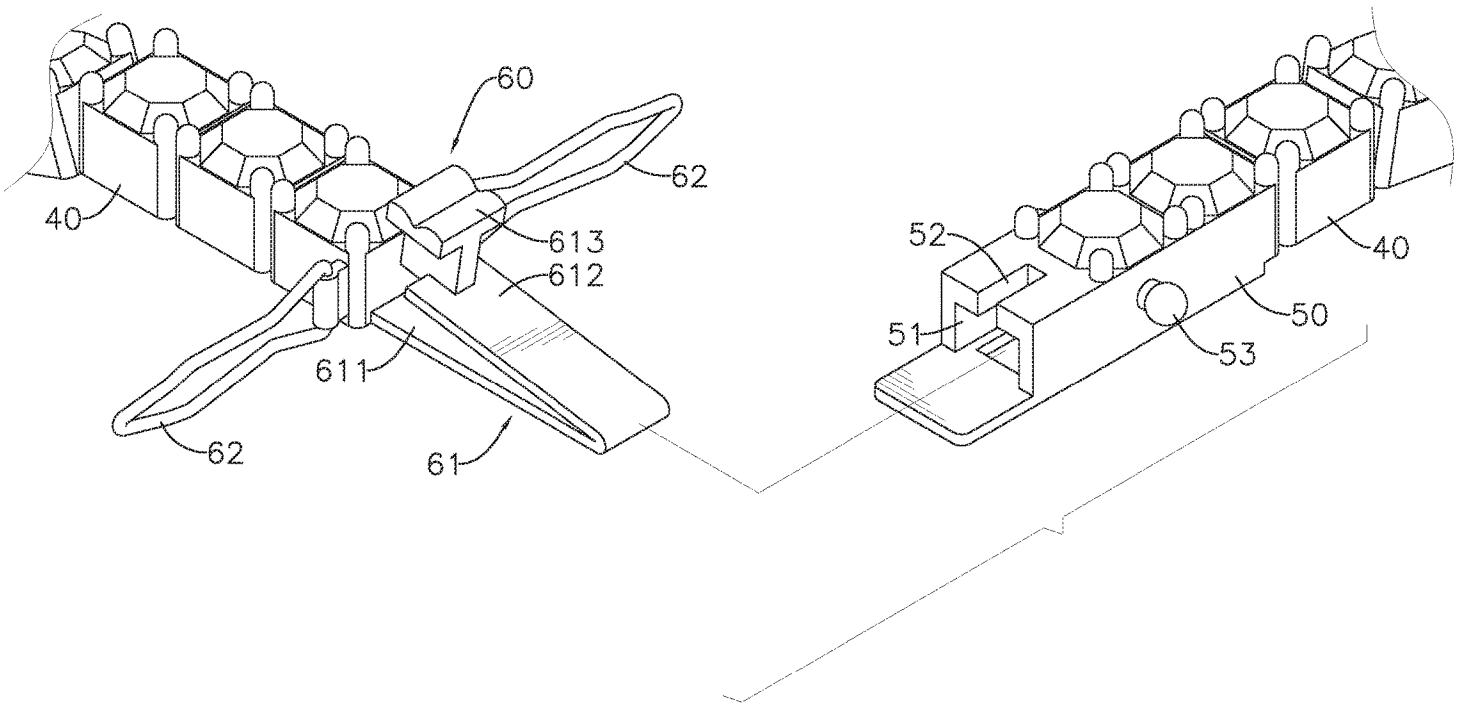
FIG. 4 PRIOR ART
FIG. 4 is an enlarged perspective view of a conventional fastening structure of jewellery in accordance with the prior art, shown unfastened.

With reference to FIGS. 1 and 3, a fastening structure of jewellery in accordance with the present invention comprises a chain 10, 10A, a locking seat 20, and a locking assembly 30.

The chain 10, 10A is slender and has two ends.

Figure 2:
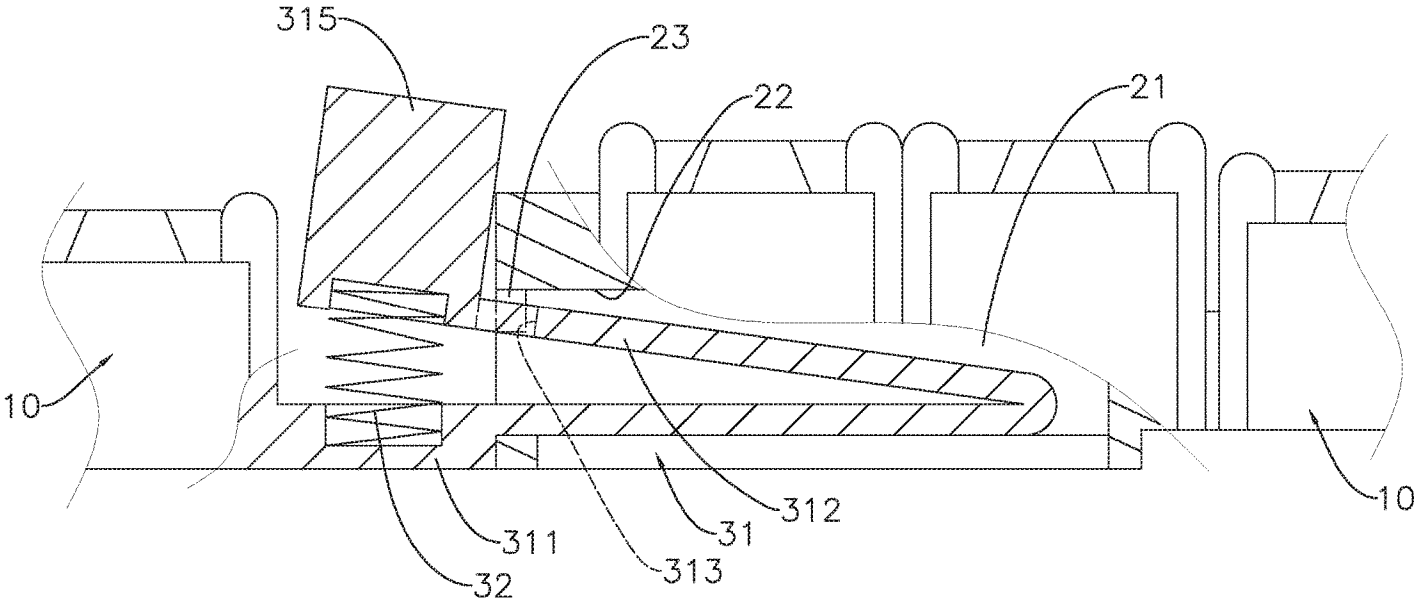
FIG. 2 is an enlarged side view in partial section of the fastening structure of jewellery in FIG. 1, shown fastened.

With further reference to FIG. 2, the locking seat 20 is attached to one of the ends of the chain 10 and has an end surface, an insertion recess 21, an inner upper wall 22, two inner sidewalls, and two stop protrusions 23. The insertion recess 21 is formed in the end surface of the locking seat 20. The inner upper wall 22 is defined in the insertion recess 21. The inner sidewalls are defined in the insertion recess 21 and are oppositely disposed beside the inner upper wall 22. The stop protrusions 23 are separately formed on the inner upper wall 22 of the locking seat 20. The stop protrusions 23 are disposed next to each other and are disposed adjacent to the end surface of the locking seat 20 and adjacent to the inner sidewalls of the locking seat 20 respectively.

The locking assembly 30 is mounted on the other end of the chain 10, 10A and includes a resilient locking element 31 and a resilient supporting element 32. The resilient locking element 31 is V-shaped and has a connecting end 311, a locking end 312, an end edge 313, and a pressing protrusion 315. The connecting end 311 is attached to the chain 10, 10A. The locking end 312 is opposite to and corresponds to the connecting end 311. The end edge 313 of the resilient locking element 31 is formed on the locking end 312. The pressing protrusion 315 is attached to the end edge 313 on the locking end 312 of the resilient locking element 31. Specifically, the pressing protrusion 315 is attached to the end edge 313 on the locking end 312 of the resilient locking element 31 via an extending sheet 314. The resilient supporting element 32 is mounted between the connecting end 311 and the pressing protrusion 315 of the resilient locking element 31 and has two ends respectively abutting against the connecting end 311 and the pressing protrusion 315. Specifically, the resilient supporting element 32 is a compression spring.

In the preferred embodiment as shown in FIG. 1, the chain 10 includes multiple settings 11. The settings 11 are pivotally connected to each other in series. Each of the settings 11 is capable of being embedded with a decorative item, such as a crystal, a jewel, or the like. The locking seat 20 and the locking assembly 30 are respectively mounted on two of the settings 11 that are disposed at the two ends of the chain 10.

In another preferred embodiment as shown in FIG. 3, the chain 10A includes two half rings 12A. Each one of the half rings 12A has a pivot end and a connecting end. The pivot ends of the half rings are pivotally connected to each other. The locking seat 20 and the locking assembly 30 are respectively mounted on the connecting ends of the half rings 12A.

When the pressing protrusion 315 is pressed, the locking end 312 moves toward the connecting end 311 and the resilient supporting element 32 is compressed. When the pressing protrusion 315 is released, the resilient supporting element 32 resiliently pushes the locking end 312 to move backwardly.

As shown in FIG. 2, when the resilient locking element 31 is inserted into the insertion recess 21 of the locking seat 20, the end edge 313 on the locking end 312 of the resilient locking element 31 abuts against the stop protrusions 23 of the locking seat 20. With the resilient supporting element 32 mounted between the connecting end 311 and the pressing protrusion 315 and pushing the connecting end 311, the locking end 312 is firmly held by the stop protrusion 23. For removing the resilient locking element 31 out of the locking seat 20, the pressing protrusion 315 is pressed to allow the end edge 313 on the locking end 312 to disengage from the stop protrusions 23 of the locking seat 20.

The fastening structure of jewellery as described has a simplified structure and compact size. Moreover, the stop protrusions 23 of the locking seat 20 and the resilient supporting element 32 allow the locking seat 20 and the resilient locking element 31 to securely engage with each other. Since the locking end 312 of the locking element 31 does not disengage from the stop protrusions 23 of the locking seat 20 easily, the locking element 31 does not depart from the locking seat 20 easily. Accordingly, the jewellery with the fastening structure in accordance with the present invention does not drop off and does not get lost.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A fastening structure of jewellery comprising:
- a chain having two ends;
- a locking seat attached to one of the ends of the chain and having
  - an end surface;
  - an insertion recess formed in the end surface of the locking seat;
  - an inner upper wall defined in the insertion recess;
  - two inner sidewalls defined in the insertion recess; and
  - two stop protrusions separately formed on the inner upper wall of the locking seat, disposed next to each other, and disposed adjacent to the end surface of the locking seat and adjacent to the inner sidewalls of the locking seat respectively; and
- a locking assembly mounted on the other end of the chain and including
  - a resilient locking element being V-shaped and having
    - a connecting end attached to the chain;
    - a locking end being opposite to and corresponding to the connecting end;
    - an end edge formed on the locking end; and
    - a pressing protrusion attached to the end edge on the locking end of the resilient locking element; and
  - a resilient supporting element mounted between the connecting end and the pressing protrusion of the resilient locking element and having two ends respectively abutting against the connecting end and the pressing protrusion.

2. The fastening structure as claimed in claim 1, wherein the pressing protrusion of the resilient locking element is attached to the end edge on the locking end of the resilient locking element via an extending sheet.

3. The fastening structure as claimed in claim 2, wherein
- the chain includes multiple settings and the settings are pivotally connected to each other in series; and
- the locking seat and the locking assembly are respectively mounted on two of the settings that are disposed at the two ends of the chain.

4. The fastening structure as claimed in claim 2, wherein
- the chain includes two half rings, each one of the half rings has a pivot end and a connecting end, and the pivot ends of the half rings are pivotally connected to each other; and
- the locking seat and the locking assembly are respectively mounted on the connecting ends of the half rings.

5. The fastening structure as claimed in claim 1, wherein
- the chain includes multiple settings and the settings are pivotally connected to each other in series; and
- the locking seat and the locking assembly are respectively mounted on two of the settings that are disposed at the two ends of the chain.

6. The fastening structure as claimed in claim 1, wherein the chain includes two half rings, each one of the half rings has a pivot end and a connecting end, and the pivot ends of the half rings are pivotally connected to each other; and the locking seat and the locking assembly are respectively mounted on the connecting ends of the half rings.

* * * * *